US008167633B1

(12) United States Patent
Wu

(10) Patent No.: US 8,167,633 B1
(45) Date of Patent: May 1, 2012

(54) MULTIFUNCTIONAL TRANSMISSION AND CHARGING DEVICE WITH A POWER CONVERSION MODULE

(76) Inventor: Sung-Chiang Wu, New Taipei (TW)

( * ) Notice: Subject to any disclaimer, the term of this patent is extended or adjusted under 35 U.S.C. 154(b) by 0 days.

(21) Appl. No.: 13/085,463

(22) Filed: Apr. 12, 2011

(51) Int. Cl.
*H01R 3/00* (2006.01)

(52) U.S. Cl. ..... 439/164

(58) Field of Classification Search ..... 439/162–164, 439/21, 345, 638–640
See application file for complete search history.

(56) References Cited

U.S. PATENT DOCUMENTS 4,590,337 A * 5/1986 Engelmore ..... 439/21
5,098,028 A * 3/1992 Ida et al. ..... 242/388.6
5,980,285 A * 11/1999 Matsumoto ..... 439/164
6,341,969 B1 * 1/2002 Taniuchi et al. ..... 439/164

* cited by examiner

*Primary Examiner* — Chandrika Prasad
(74) *Attorney, Agent, or Firm* — Leong C. Lei

(57) ABSTRACT

An intelligent multifunctional transmission and charging device includes a casing, a power conversion module, a reel device, at least one cable, and a plurality of openings and connectors to provide functions of charging mobile devices and extending service lives thereof.

12 Claims, 13 Drawing Sheets

MULTIFUNCTIONAL TRANSMISSION AND CHARGING DEVICE WITH A POWER CONVERSION MODULE

(a) TECHNICAL FIELD OF THE INVENTION

The present invention generally relates to an intelligent multifunctional transmission and charging device, and more particularly to an electrical charger that provides convenient electrical charging for mobile devices.

(b) DESCRIPTION OF THE PRIOR ART

A conventional charger supplies direct currents to charge mobile devices. However, the connection ports of different mobile devices are different due to being of different brands or models. A user must acquire various charging connectors to charge different electrical devices.

On the other hand, due to the fast progress of digital devices, connection for high definition image signal is available. However, power capacity is a vital issue. Although a high definition device can be of a great data capacity and/or extremely high definition of image, insufficiency of power supply will prevent such a device for long time operation and playing.

Apparently, the conventional electrical chargers cause a lot of problems and are not perfect designs. Further, they can only provide a fixed electrical charging operation. Thus, the present invention aims to overcome such a problem.

SUMMARY OF THE INVENTION

The present invention provides an intelligent multifunctional transmission and charging device, which comprises a casing, a power conversion module, a reel device, at least one cable, and a plurality of opening and connectors. The casing comprises three portions including an upper cover, a casing body, and a lower cover. The upper cover forms a window opening. The casing forms a cable outlet opening and an electricity supply opening. The lower cover forms electrical adaption openings. The power conversion module, the reel device, and the cable are all arranged inside the casing. The casing and the upper cover are secured together through at least one fastening member.

The reel device comprises a rotary body forming a cylindrical recess. The rotary body has an outer circumferential surface forming a circumferential groove and forms the cylindrical recess in a central portion thereof. The cylindrical recess forms centrally a through hole in a bottom thereof, showing a ring-like configuration to be rotatably fit to a central shaft formed in the casing.

The reel device further comprises a rotary module, which comprises an electricity supply port and a circuit board. The circuit board is electrically connected by electrical wires received in the central shaft to the power conversion module. The rotary module is mounted on the rotary body. The electricity supply port matches the window opening.

The cable has an end electrically connected through the rotary body to the rotary module and is wound around the circumferential groove of the rotary body. The cable has an opposite end extending outward through the cable outlet opening.

Preferably, the reel device comprises a rotary enclosure cap, which is in the form of a cap and is arranged between the upper cover and the rotary body to rotatably mate the window opening of the upper cover. The rotary enclosure cap forms in a central portion thereof at least one opening to match the at least one electricity supply port.

Preferably, the cable outlet opening comprises at least two rollers mounted in board thereof to facilitate the cable to be pulled out of the cable outlet opening.

Preferably, the cylindrical recess comprises a spring lid, which separates the elastic member from the rotary module.

Preferably, the external connection plug is mounted, in a foldable manner, by a foldable support in electrical adaption openings of the lower cover.

Preferably, the connector portion, the electricity inlet port, and the electricity supply port selectively comprise a USB connector, a MINI USB connector, a MICRO USB connector, an HDMI connector, and a connector for tablet computer.

The primary objective of the present invention is to provide stable supply of electrical power and extend the service life of a mobile device carried by a user. Another objective of the present invention is to provide a user multiple choices of connection interfaces and to provide a function of extension cord so as to facilitate the convenience of use.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
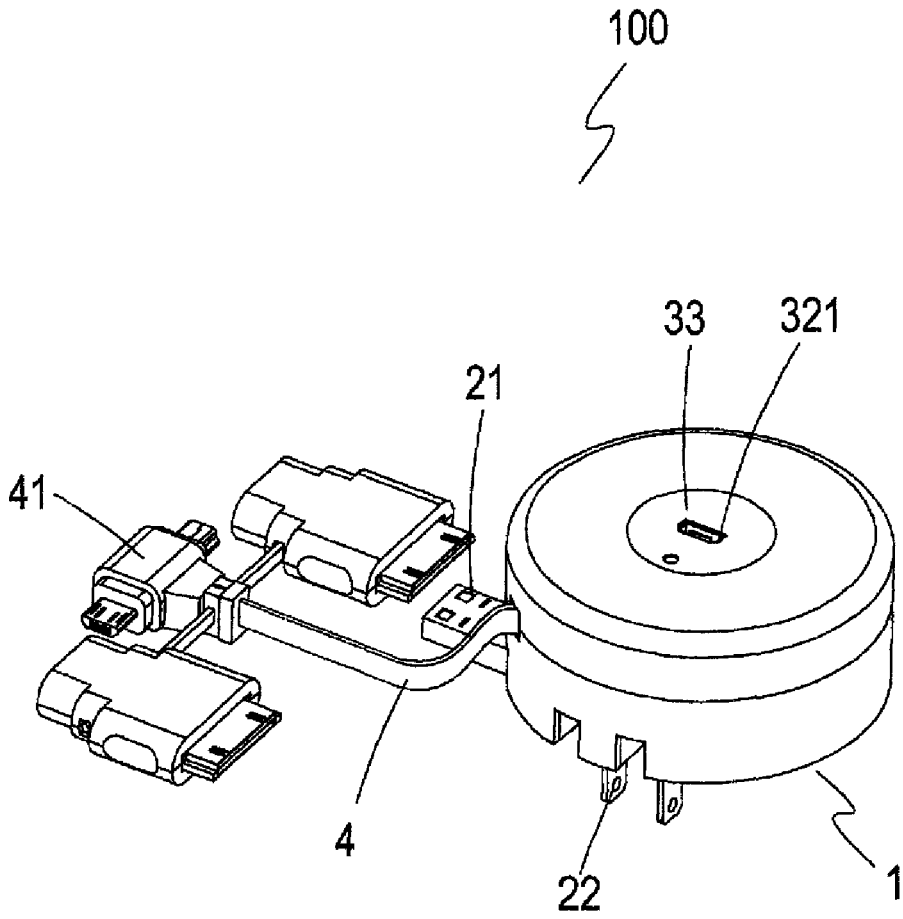
FIG. 1 is a perspective view of the present invention.

Referring to FIG. 1, a perspective view of an intelligent multifunctional transmission and charging device 100 according to the present invention is shown, which comprises a casing 1, a connector portion 41, and an electricity inlet port 21 and an electricity supply port 321, which are visible.

Referring to FIGS. 2-7, a spatial arrangement of internal parts constituting an upper enclosure portion is shown, including the casing 1 and an upper cover 11 attachable to the casing to define an internal space which receives therein a reel device 3 and a cable 4. The casing body 12 comprises at least one fastening member 126 to which the upper cover 11 is secured, preferably through threading engagement.

The reel device comprises a rotary body 31, which has an outer circumferential surface forming a circumferential groove 311 to receive the cable 4 reeled in thereon. The rotary body 31 forms, centrally, a cylindrical recess 312 and a circumferential rim 317, which is provided with vertical tabs 3171 formed externally thereof and forms coupling notches 3172, extending circumferentially around the cylindrical recess. The cylindrical recess 312 forms centrally in a bottom thereof a through hole 315, which is rotatably fit over a hollow central shaft 121 formed in the casing body 12. A raised, auxiliary rail is formed circumferentially around the central shaft and a fan-shaped slot 1243 is formed nearby the central shaft. The fan-shaped slot receives therein a tongue 124 that carries a protrusion dot 1241 thereon, whereby the tongue is allowed to sway inside the fan-shaped slot 1243. The rotary body 31 is provided with a track 316 opposing the casing body 12 to slidably receive the tongue protrusion dot 1241 and the raised auxiliary rail 129 therein, whereby a "stepped" rotation process is realized between the casing body 12 and the rotary body 31 during the relative rotation thereof for stepwise positioning of the rotary body.

The cylindrical recess 312 receives therein an elastic member 313, which, in the embodiment illustrated, is a coil spring having an end fit into and fixed to a slit 313*b* defined in the centrals shaft and an opposite end fit into and fixed to a slit 313*a* so as to retain the coil spring in the recess to provide a spring force or winding the cable. A spring lid 314 is positioned on the elastic member 313 and is provided with a rotary module 32 that comprises a circuit board 322 and the electricity supply port 321. The rotary module has an outer circumference forming a plurality of lugs 3221 that engage and mate the coupling notches 3172 to securely retain the circuit board 322 on the rotary body.

Further, a rotary enclosure cap 33 is arranged between the rotary module 32 and the upper cover 11. The rotary enclosure cap 33 matches a window opening 111 formed in the upper cover. The rotary enclosure cap 33 has an underside forming a lower circumferential flange in which a plurality of slits 331 is defined to engage and mate the vertical tabs 3171, whereby the reel device 3 that comprises the cable 4 wound thereon is rotatably received and retained in a space between the casing body 12 and the upper cover 11 to allow unwinding and extension of the cable from the reel device.

The casing body 12 comprises two parallel-arranged rollers 125 inboard of a cable outlet opening 122 of the casing 1. Each of the rollers 125 comprises a sleeve 1251 that is rotatably fit over an axle 1252 between the upper cover 11 and the casing body 12, so as to protect the cable 4 from abrasion against edges of the opening during extension through the cable outlet opening 122 and achieve smooth withdrawal of the cable.

Referring to FIGS. 8-11, a spatial arrangement of internal parts constituting a lower enclosure portion is shown, including the casing 1 and a lower cover 13 attachable to the casing to define an internal space which receives therein a power conversion module 2. An electricity supply opening 123 and electrical adaption openings 131 are formed to respectively allow the electricity inlet port 21 and an external connection plug 22 to extend out of the casing. The external connection plug 22 is mounted by a foldable support 23 to a power transformation module 24 so as to be foldable through the support 23. The casing body 12 forms notches 128 that are combined with the electrical adaption openings 131 to allow the plug 22 to be folded into folding spaces formed inside the electrical adaption openings 131. The casing body 12 forms therein stop blocks 127, on which the lower cover 13 is positionable to neatly fit the lower cover in the casing body 12.

Figure 2:
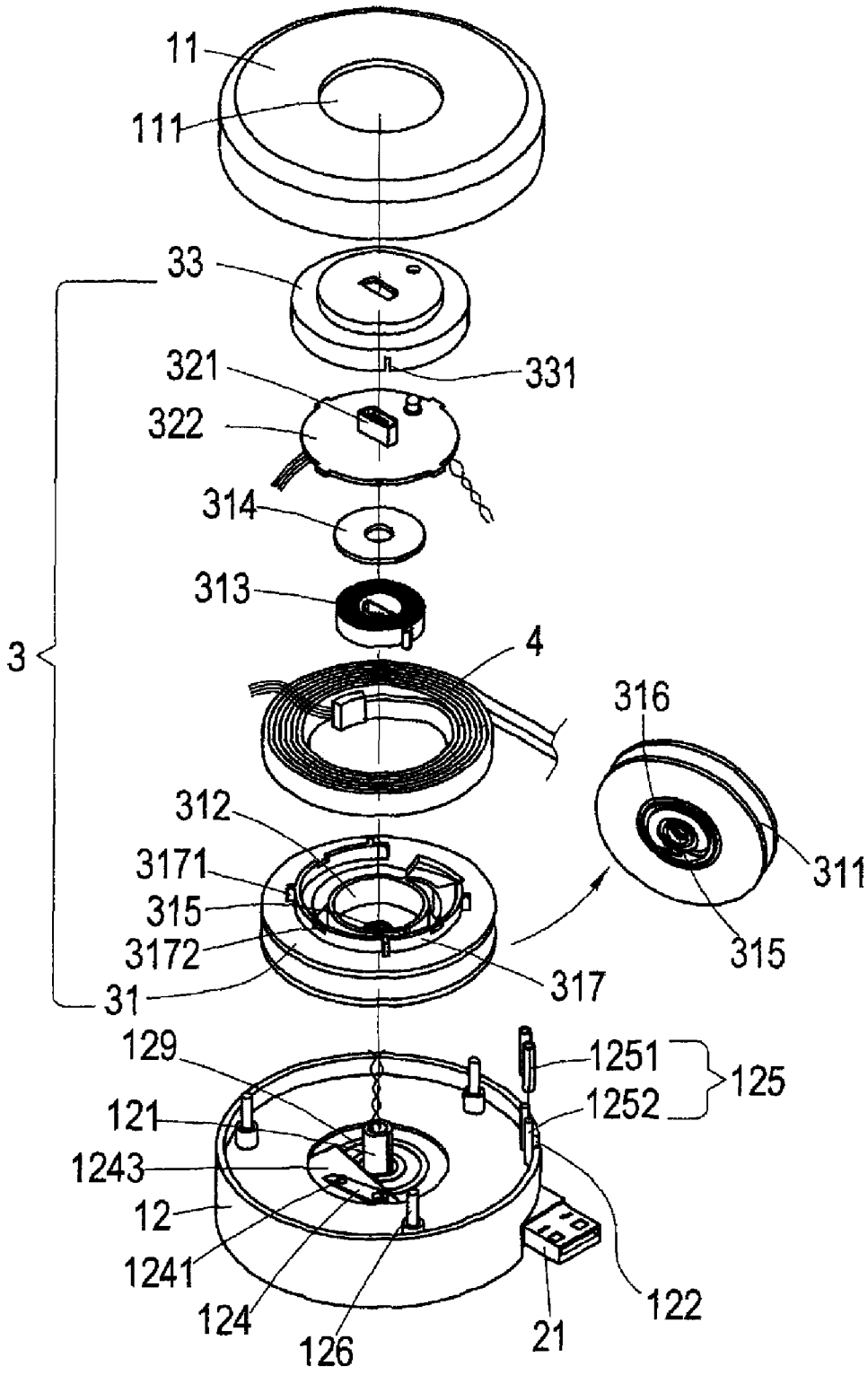
FIG. 2 is an exploded view of an upper cover of the present invention.
Figure 3:
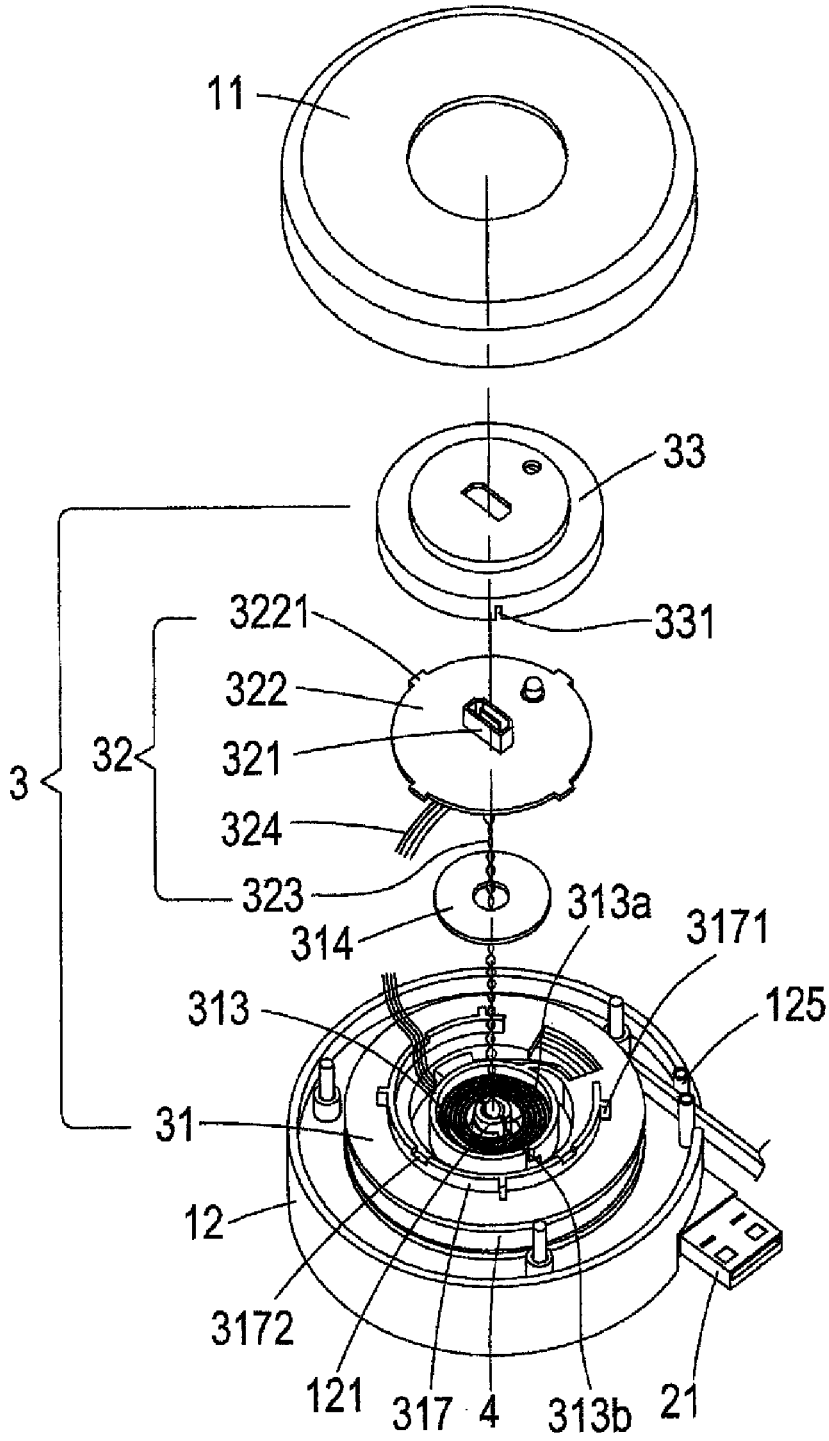
FIG. 3 is another exploded view of the upper cover of the present invention.
Figure 4:
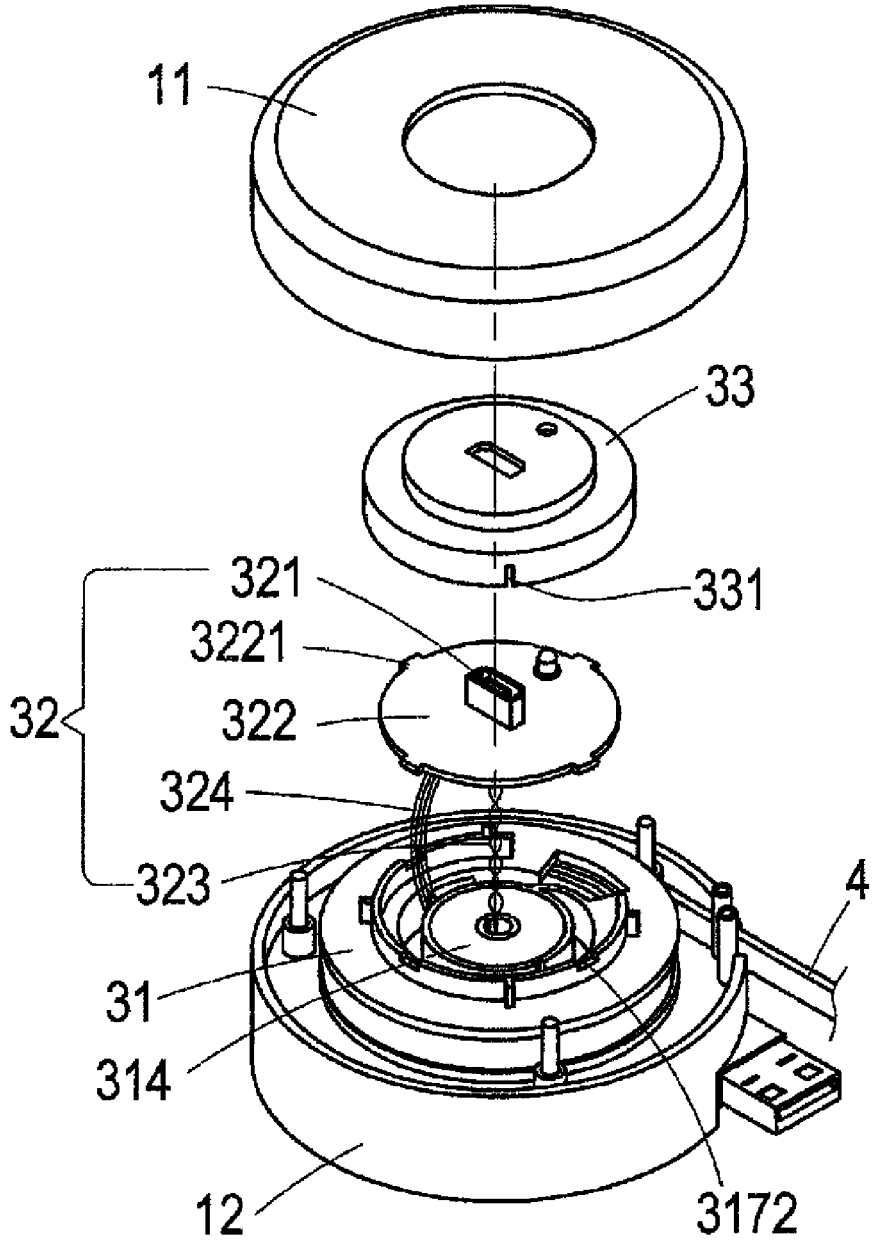
FIG. 4 is another exploded view of the upper cover of the present invention.
Figure 5:
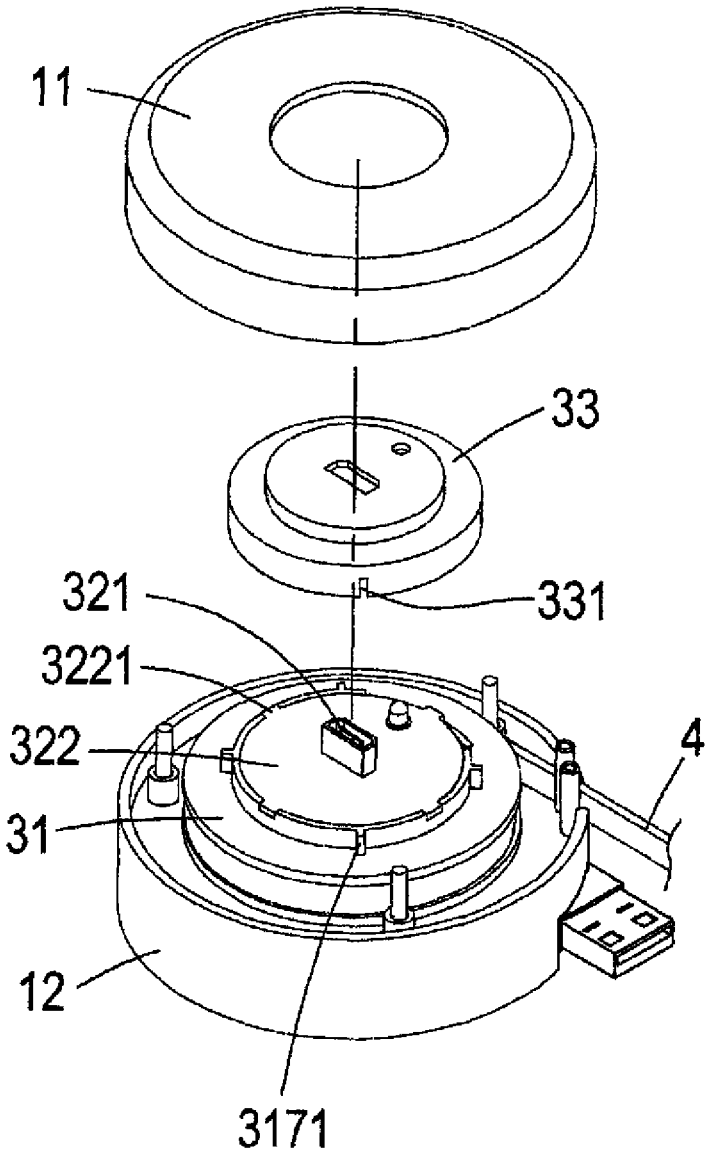
FIG. 5 is another exploded view of the upper cover of the present invention.
Figure 6:
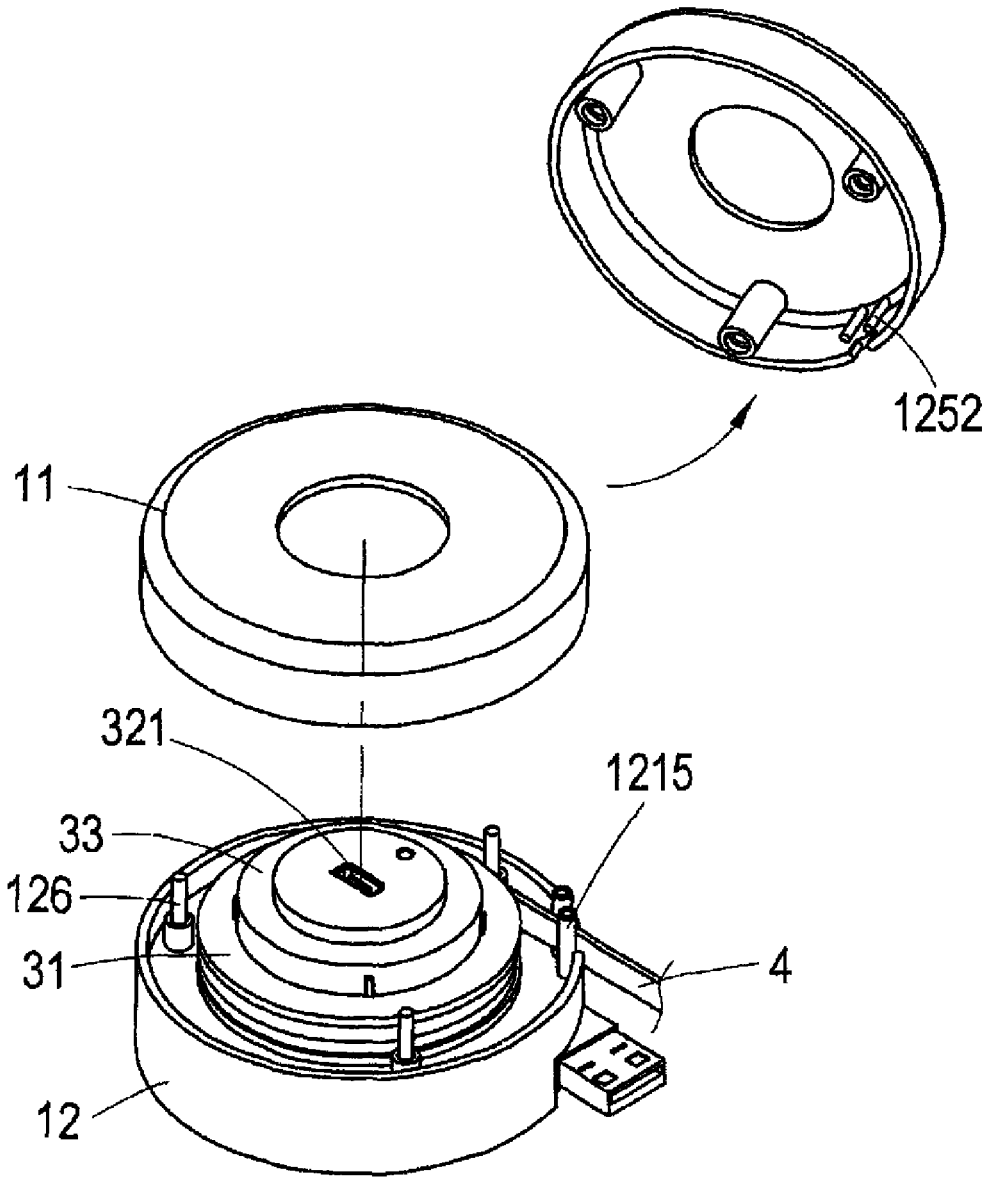
FIG. 6 is a further exploded view of the upper cover of the present invention.
Figure 9:
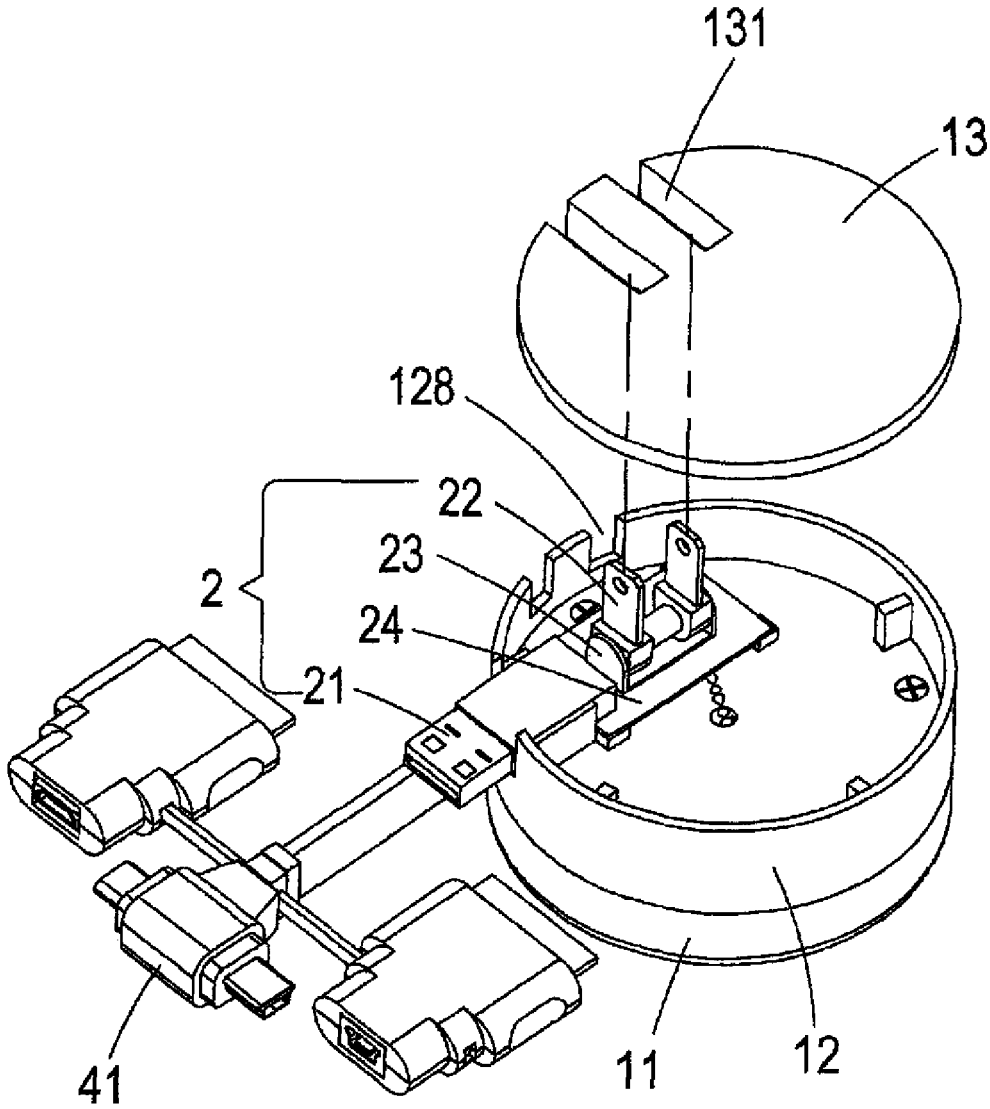
FIG. 9 is an exploded view illustrating inside details of the lower cover according to the present invention.
Figure 10:
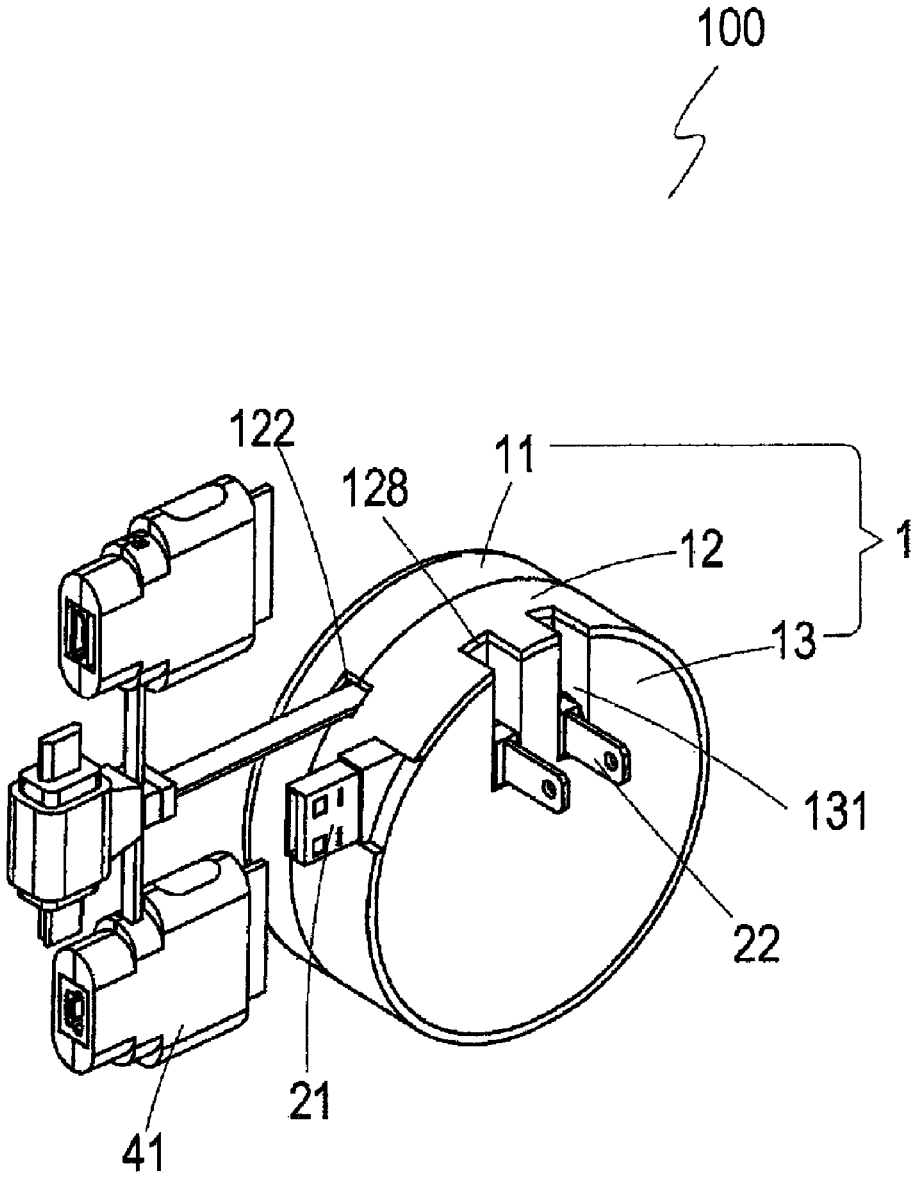
FIG. 10 is a perspective view showing a bottom side of the present invention.
Figure 11:
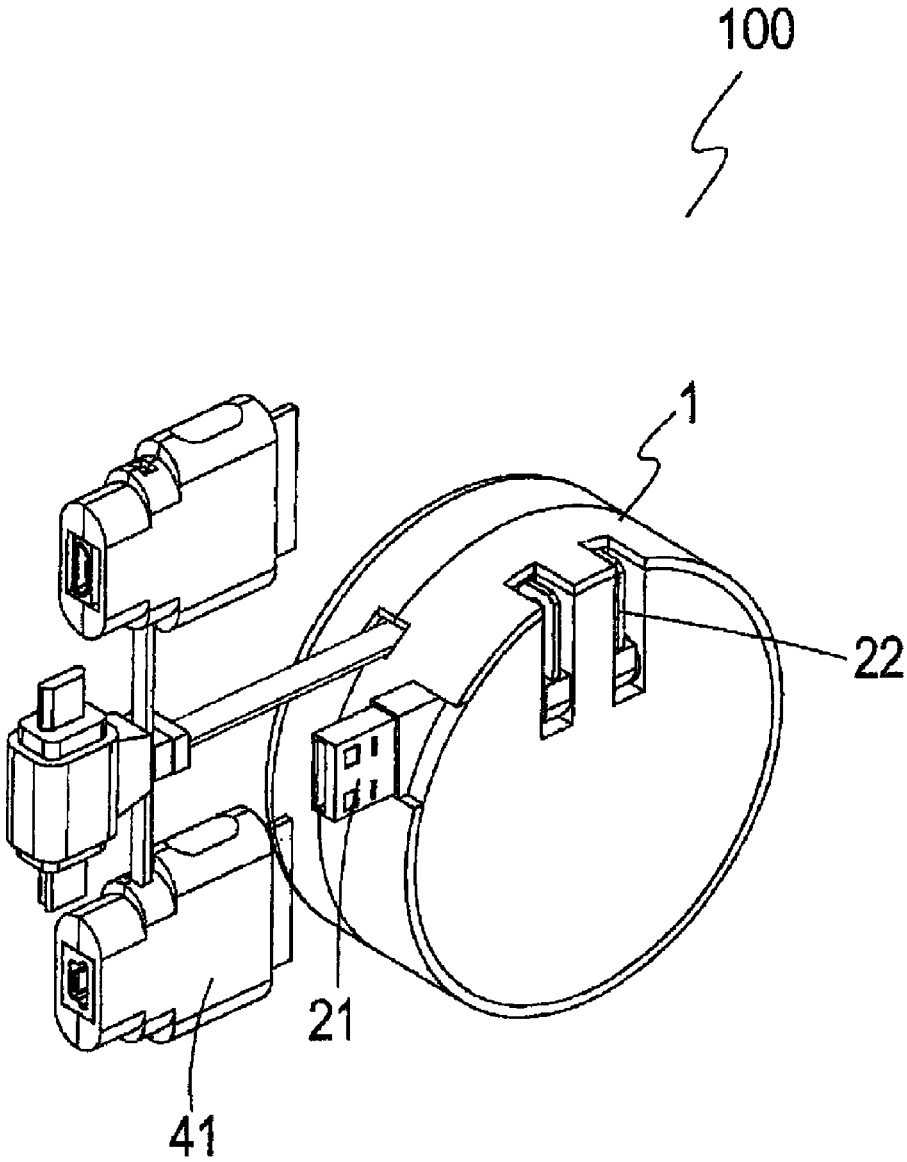
FIG. 11 is a perspective view showing an external connection plug in a folded and stowed condition according to the present invention.

Referring to FIGS. 2 and 9, twisted twin wires 323, which are preferably flexible and bendable, are attached to and extend from the rotary module 32 through a hollow portion of the central shaft 121 to connect to the power transformation module 24. An electrical cord 324 is electrically connected to an end of the cable 4. As such, electricity may transmit through the electricity inlet port 21 or the external connection plug 22 to supply to the connector portion 41 and the electricity supply port 321.

Figure 7:
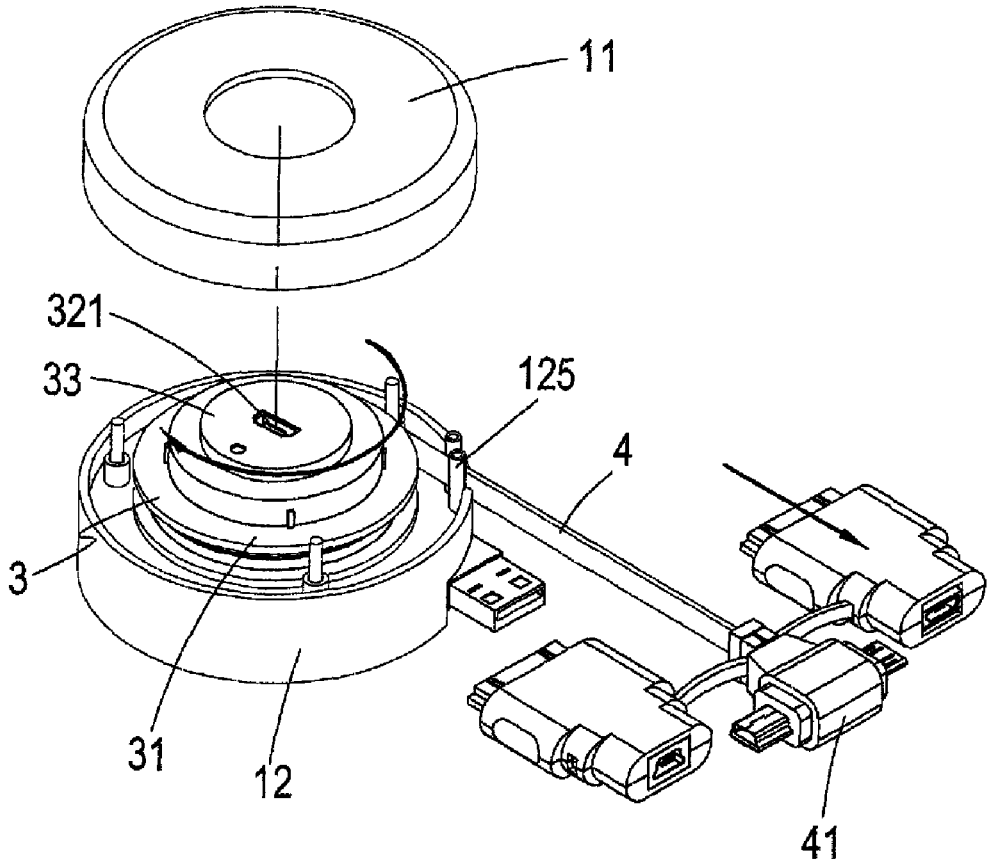
FIG. 7 is a perspective view, with the upper cover detached, illustrating unwinding of a cable according to the present invention.
Figure 8:
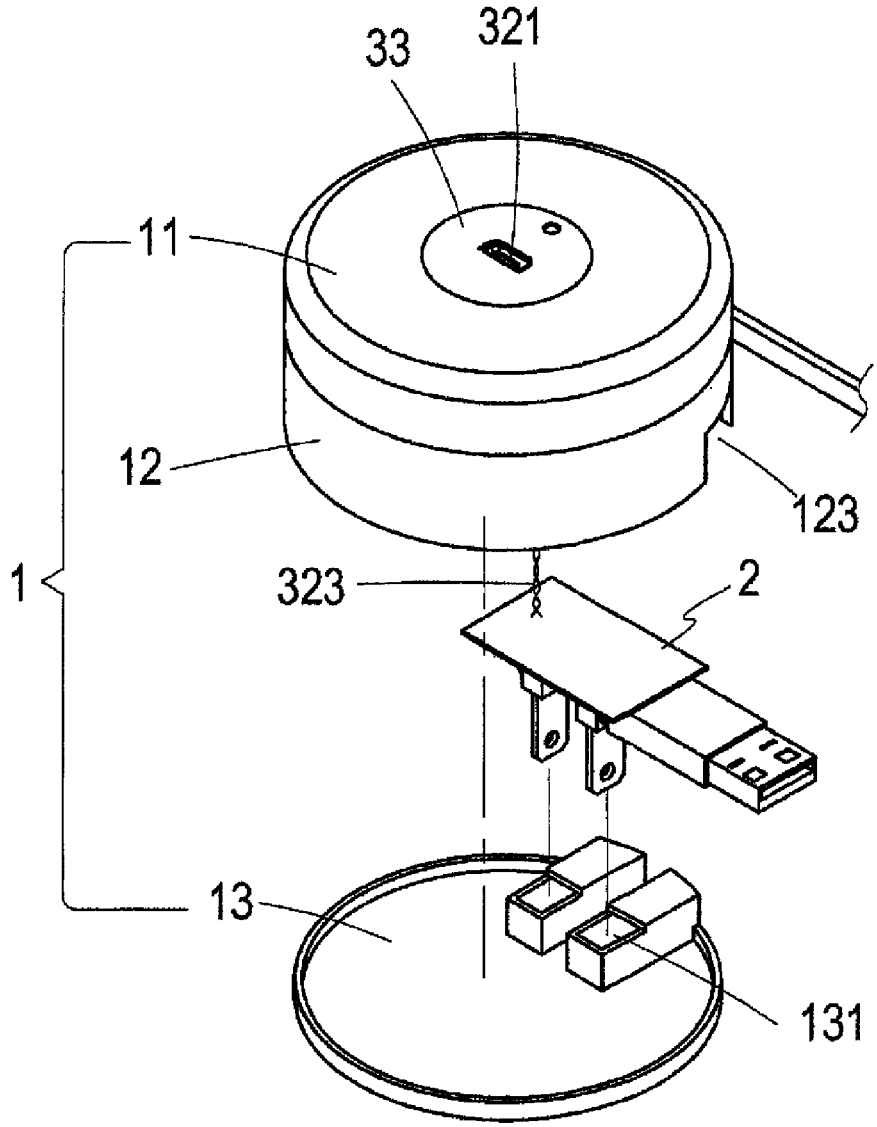
FIG. 8 is an exploded view of a lower cover of the present invention.

Referring to FIGS. 4 and 7-9, the twisted twin wires 323 are set in a tightly twisted condition when the cable 4 is received in the casing; and as shown in FIG. 7, when the cable 4 is pulled out of the casing 1 to a stretched condition, the twisted twin wires show a loosened condition. The purpose of this arrangement is to protect electrical wires that are connected to electrical components inside the upper cover and the lower cover from be broken due to the rotation of the reel device. The connector portion 41 that is attached to the cable 4 comprises a plurality of connectors of various interfaces mounted to the same cable. The connectors may respectively connect to USB, MINI USB, MICRO USB, and tablet computer.

In summary, in pulling the cable 4 out of the casing 1, the rotary body 31 is rotated through the tongue 124 and the track 316, the elastic member 313 is tensioned. The tongue protrusion dot 1241 and the track 316 provide retained positioning to accumulate and keep spring force that serves as a power for rewinding the cable 4. To rewind the cable, the cable is pulled again to release the tongue protrusion dot from retained positioning engagement with the track, so that the power stored in the elastic member 313 is released to rewind the cable.

Further, when the present invention use the plug 22 to receive electricity from an external power source, the electricity supply port 321, the electricity inlet port 21, and each connector of the connector portion 41 receive corresponding electricity. When there is no external power source, the electricity supply port 321, the electricity inlet port 21, and the connector portion 41 may serve as a length-extended multi-interface signal connection line.

Figure 12:
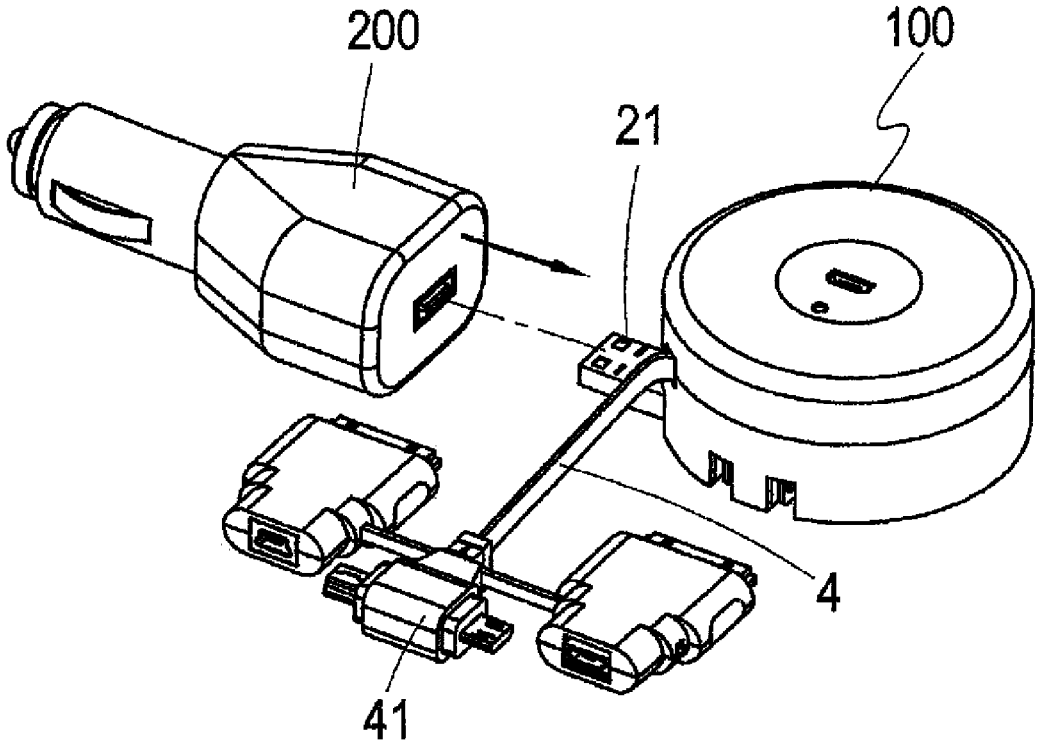
FIG. 12 is a perspective view illustrating an application of the present invention to an automobile power adaptor.

Referring to FIG. 12, the electricity inlet port 21 of the intelligent multifunctional transmission and charging device 100 may additionally connect to an automobile power adaptor 200, which may provide external power to the present invention so that a mobile device may be charged in an automobile through the connector portion 41 mounted at an end of the cable 4 to extend the time of service thereof.

Figure 13:
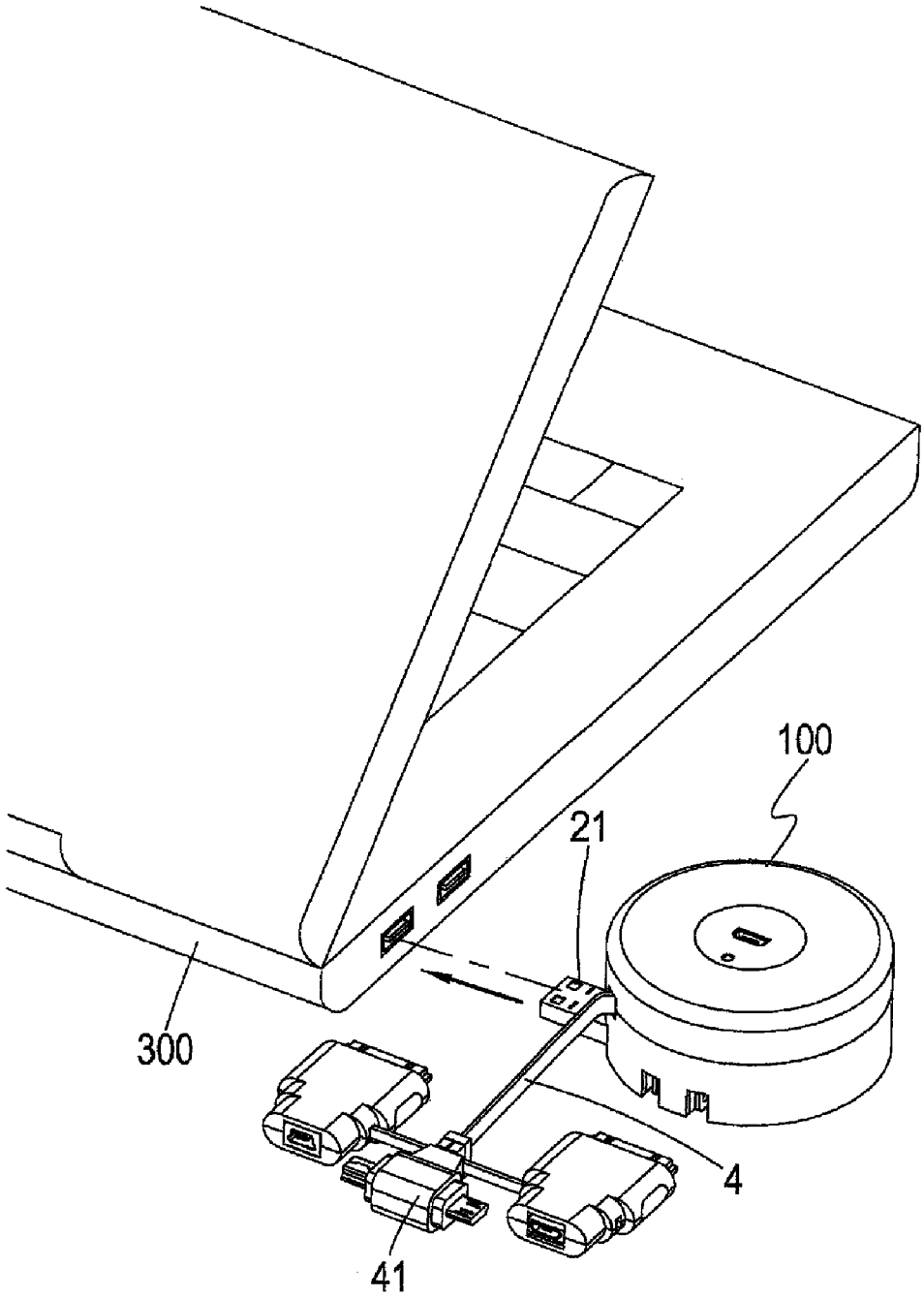
FIG. 13 is a perspective view illustrating an application of the present invention to a notebook computer.

Referring to FIG. 13, the electricity inlet port 21 of the intelligent multifunctional transmission and charging device 100 according to the present invention is connectable to a USB port of a notebook computer 300, whereby with the extendibility of the connector portion 41 mounted to an end of the cable 4, a USB extension cable is realized, or charging may be performed 0.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An intelligent multifunctional transmission and charging device, comprising:

a casing, in which a hollow central shaft is formed, the casing comprising an upper cover, a casing body, and a lower cover, the lower cover being coupled through the casing body to the upper cover, the casing body forming a cable outlet opening and an electricity supply opening, the upper cover forming at least one window opening, the lower cover forming at least one electrical adaption opening, the casing body comprising a tongue;

a power conversion module, which is arranged inside the casing and comprises a power transformation module, an electricity inlet port matching the electricity supply opening, an external connection plug matching the electrical adaption openings to extending outside the casing;

a reel device, which is received in the casing and comprises:

a rotary body, which comprises a ring-like configuration having outer circumferential surface forming a circumferential groove and a central portion forming a cylindrical recess, the cylindrical recess forming centrally a through hole in a bottom thereof, which is rotatably fit over the central shaft, the rotary body forming a track in a surface thereof opposing the casing body to operate with the tongue;

an elastic member, which is received in the cylindrical recess and has an end attached to the central shaft and an opposite end attached to the rotary body; and a rotary module, which comprises at least one electricity supply port and a circuit board, the circuit board being electrically connected by electrical wires received through the central shaft to the power conversion module, the rotary module being mounted to the rotary body, the electricity supply port matching the window opening; and at least one cable, which has an end electrically connected through the rotary body to the rotary module and is wound around the circumferential groove of the rotary body, the cable having an opposite end extending outward through the cable outlet opening to connect to a connector portion.

2. The intelligent multifunctional transmission and charging device according to claim 1, wherein the reel device comprises a rotary enclosure cap, which is in the form of a cap and is arranged between the upper cover and the rotary body to rotatably mate the window opening of the upper cover, the rotary enclosure cap forming in a central portion thereof at least one opening to match the at least one electricity supply port.

3. The intelligent multifunctional transmission and charging device according to claim 1, wherein the cable outlet opening comprises at least two rollers mounted in board thereof to facilitate the cable to be pulled out of the cable outlet opening.

4. The intelligent multifunctional transmission and charging device according to claim 1, wherein the cylindrical recess comprises a spring lid, which separates the elastic member from the rotary module to eliminate abrasion.

5. The intelligent multifunctional transmission and charging device according to claim 1, wherein the power conversion module comprises a foldable external connection plug, which is mounted, in a foldable manner, by a foldable support in electrical adaption openings defined in the lower cover and is electrically connected to the power transformation module.

6. The intelligent multifunctional transmission and charging device according to claim 1, wherein the electricity inlet port comprises an automobile cigarette lighter male connector and a USB connector.

7. The intelligent multifunctional transmission and charging device according to claim 1, wherein the connector portion selectively comprises a USB connector, a MINI USB connector, a MICRO USB connector, an HDMI connector, and a connector for tablet computer.

8. The intelligent multifunctional transmission and charging device according to claim 1, wherein the electricity inlet port selectively comprises a USB connector; a MINI USB connector, a MICRO USB connector, an HDMI connector, and a connector for tablet computer.

9. The intelligent multifunctional transmission and charging device according to claim 1, wherein the electricity supply port selectively comprises a USB connector; a MINI USB connector, a MICRO USB connector, an HDMI connector, and a connector for tablet computer.

10. The intelligent multifunctional transmission and charging device according to claim 1, wherein the electrical wires received in the central shaft comprises at least two wires twisted together to form a set of twisted twin wires.

11. The intelligent multifunctional transmission and charging device according to claim 1, wherein the casing and the upper cover are secured together through at least one fastening member.

12. The intelligent multifunctional transmission and charging device according to claim 1, wherein a circumferential rim is formed around the cylindrical recess, the rim forming a plurality of coupling notches to engage a plurality of lugs formed along a circumference of the circuit board.

* * * * *